United States Patent [19]

Wallace

[11] Patent Number: 4,483,153

[45] Date of Patent: Nov. 20, 1984

[54] WIDE ISLAND AIR DEFROST REFRIGERATED DISPLAY CASE HAVING A DEFROST-ONLY CENTER PASSAGE

[75] Inventor: George E. Wallace, Levittown, Pa.

[73] Assignee: Emhart Industries, Inc., Farmington, Conn.

[21] Appl. No.: 484,394

[22] Filed: Apr. 13, 1983

Related U.S. Application Data

[63] Continuation-in-part of Ser. No. 463,082, Feb. 2, 1983, Pat. No. 4,439,993.

[51] Int. Cl.[3] ..... A47F 3/04; F25D 21/12

[52] U.S. Cl. ..... 62/256; 62/82

[58] Field of Search ..... 62/82, 282, 256

[56] References Cited

U.S. PATENT DOCUMENTS

| | | | |
|---|---|---|---|
| 3,850,003 | 11/1974 | Beckwith et al. | 62/82 |
| 4,182,130 | 1/1980 | Ljung | 62/82 |
| 4,267,706 | 5/1981 | Abraham | 62/256 |
| 4,304,098 | 12/1981 | Rydahl | 62/82 |
| 4,314,457 | 2/1982 | Ibrahim | 62/256 |
| 4,320,631 | 3/1982 | Vana | 62/256 |
| 4,337,626 | 7/1982 | Ibrahim | 68/82 |

*Primary Examiner*—William E. Wayner

*Attorney, Agent, or Firm*—Frederick A. Zoda; John J. Kane

[57] ABSTRACT

A wide island, open top refrigerated display case of the air defrost type has a vertical, hollow partition extending centrally and longitudinally of the case. The partition functions, during defrost cycles only, as an air passage through which the flow of defrost air is induced by operation of a defrost fan mounted in a hollow sill extending along the top of the partition. During refrigeration cycles, the fan is idle and there is no air flow within the partition, so that it forms a hollow dead air space operative to insulate from one another the product wells separated by the partition, a feature of particular importance when one well is refrigerated to a temperature different from the other. Various configurations are disclosed, in some of which the air is forced downwardly within the center flue or passage during defrost, while in others the air is drawn upwardly through the defrost passage. In some configurations, the primary fan or fans are operated in a normal forward direction during defrost, while in others they are reversed or are turned off.

23 Claims, 12 Drawing Figures

WIDE ISLAND AIR DEFROST REFRIGERATED DISPLAY CASE HAVING A DEFROST-ONLY CENTER PASSAGE

The present application is a continuation-in-part of application Ser. No. 463,082 filed Feb. 2, 1983 now U.S. Pat. No. 4,439,993.

BACKGROUND OF THE INVENTION

1. Field Of The Invention

The present invention relates generally to commercial refrigeration, and in a more particular sense has reference to refrigerated display cases of the type used in food markets.

There are many basic types of refrigerated display cases, and in one sense, all of these cases can be divided into two broad categories: (a) those in which the customer access openings are normally closed by doors, known in the industry as "reach-in" cases; and (b) those in which the access openings are uncovered during normal store hours, with the access openings being either in the top or in the front of the cases.

The present invention relates to the second category. Within this category, again there are various types of cases, including open top and open front cases. The present invention relates to those categorized as open top cases, and in a more specific sense, relates to those cases of the open top type known as "wide island" display cases, wherein two side-by-side product display wells open upwardly and have a longitudinally and centrally extending partitioning structure. Cases of this type, during refrigeration cycles, have air flow patterns individual to the separate product wells, with air generally flowing completely around the sides, bottom, and across the open top of each well. Often, wide island cases have their individual product wells refrigerated to different temperatures, that is, one side of the case may be refrigerated to a temperature designed to properly maintain ice cream, while the other may be refrigerated for holding frozen foods, in a typical installation.

2. Description of the Prior Art

Refrigerated display cases, including those of the wide island, open top type, are typically defrosted in one of three ways, namely, electrical, hot gas, and air. The first approach utilizes electrical resistance heaters strategically placed to assure defrosting of the evaporators when the defrost cycle is initiated. The second utilizes a system of valved piping through which hot, compressed gaseous refrigerant is directed from the outlet side of the compressors, for flow in a reverse direction through the evaporator or evaporators being defrosted. The third arrangement utilizes air drawn from the ambient atmosphere surrounding the case, the air being caused to flow through the ducting through which refrigerated air is circulated during the refrigeration cycle, so as to flow through the evaporators.

Each approach has advantages and disadvantages. Electrical defrost is highly efficient, but may involve a high energy cost, particularly in geographical areas where electrical energy comes at a high price.

The hot gas system disclosed in patents such as U.S. Pat. Nos. 3,905,202 to Taft et al or 4,151,722 to Willitts et al, is highly effective, but is not favored by some users who believe that the efficiency of this system is outweighed by a higher initial cost and subsequent servicing requirements.

There is, too, what might be considered as a sub-classification of the hot gas defrost system, in which defrosting is effected by so-called "cool gas." In this arrangement, exemplified by U.S. Pat. No. 3,427,819 to Seghetti and U.S. Pat. No. 4,167,102 to Willitts, saturated gaseous refrigerant is circulated through a piping system similar to that used in hot gas defrost.

Air defrost, in which the means for melting frost from the evaporators is ordinary ambient air, has an obvious advantage over the other methods, in that it does not require electrical resistance devices as the primary source of heat to be applied to the evaporators, nor does it require special piping or valving above and beyond that needed during the refrigeration cycle. It does have disadvantages, however, in that the defrost cycle may be over-long, or alternatively, there may be excessive heat exchange between the refrigerated food products and the ambient air used for defrost purposes, causing the temperature of the food products to be elevated to an undesirable extent during the defrost cycle.

Accordingly, prior art patents that have concerned themselves with the use of ambient air as the defrosting means have sought to minimize the length of the defrost cycle as well as the effect of the ambient air upon the refrigerated food products. The challenge becomes particularly significant in cases of the open front or open top type, and even more so in wide island, open top cases. This is so because in a wide island case, the defrost air pattern for one side of the case may affect or be affected by the defrost air flow pattern at the other side. Also, it is difficult to provide a continuing fresh supply of ambient air for both sides of a wide island case. Still further, in some wide island cases, refrigeration at one side is produced at a temperature different from that of the other side, presenting special problems in the length of time required for the air defrost cycle when both sides are being simultaneously defrosted.

Continuing efforts have been made in the art to increase the efficiency of air-defrosted wide island cases. Typical among the patents that have been granted in this category are U.S. Pat. Nos. 4,182,130 to Ljung; 4,337,626 to Ibrahim; 4,304,098 to Rydahl; 4,314,457 to Ibrahim; and 4,337,626, also to Ibrahim.

All of these patents have approached the problems inherent in providing air defrost for wide island cases, by utilizing arrangements wherein both sides of the wide island case must be refrigerated to the same temperture, and/or heat exchange between the opposite sides of the cases during refrigeration is not appreciably reduced and indeed in some instances is increased. While a heat exchange between the opposite sides of the case, tending to equalize temperatures therebetween, is not a problem when both sides are being refrigerated to the same temperature, it is obviously undesirable when, for example, one side is to hold frozen foods and the other side is to hold ice cream, with the maintained temperatures of the product display spaces being of necessity at different levels.

It is, accordingly, one object of the present invention to provide a wide island case of the air defrost type, wherein in one form of the invention in which the opposite sides of the case are maintained at different temperatures when in a refrigeration mode, both sides can share, simultaneously, a common defrost cycle.

Another important object of the invention is to provide a case of the type described wherein the defrost cycle will be held to a desirably low length.

Yet another object is to provide a case as described in which the refrigerated food products will be effectively protected during the defrost cycle.

SUMMARY OF THE INVENTION

Summarized briefly, the invention is a wide island refrigerated display case in which there is provided, as a divider between the opposite sides of the case, a hollow center partition. The hollow partition is open at its lower end, opening upon the lower passages or plenums of the ducts through which air is circulated about the product display spaces during the refrigerating cycles. Normally, during refrigeration, the hollow partition provides an air space in which there is no air movement, thus effectively offering positive insulation between the opposite sides of the case, so as to keep heat exchange between the cases at a desirable minimum during refrigeration, a feature which is of particular importance when one side is being refrigerated to a temperature different from the other.

At the upper end of the hollow center partition there is provided a sill, containing one or more defrost fans or blowers. During a defrost cycle, these are operated to, in some forms of the invention, force air downwardly within the center passage, into the plenums or lower air passages of the ducting that extends about the product display spaces. Primary fans within the ducts provided at opposite sides of the partition in some instances remain off during defrost, so that the sill-mounted defrost fans maintain all the air flow during the defrost cycle. In other forms of the invention, the air is drawn upwardly through the center partition by the defrost fans, and is exhausted to ambient in a manner to assure that there is a fresh supply of ambient air being drawn into the case at all times during the defrost cycle.

In conjunction with the above-designated arrangements, the primary fans of the case can be left off in some defrost arrangements; can be left on in a normal forward direction in other arrangements; or in still other arrangements can be reversed. All of these arrangements are possible without material design changes, thus increasing the versatility of the basic case design with respect to meeting the particular, differing needs or desires of those who would purchase the equipment for use in food markets.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

BRIEF DESCRIPTION OF THE PREFERRED EMBODIMENT

Figure 1:
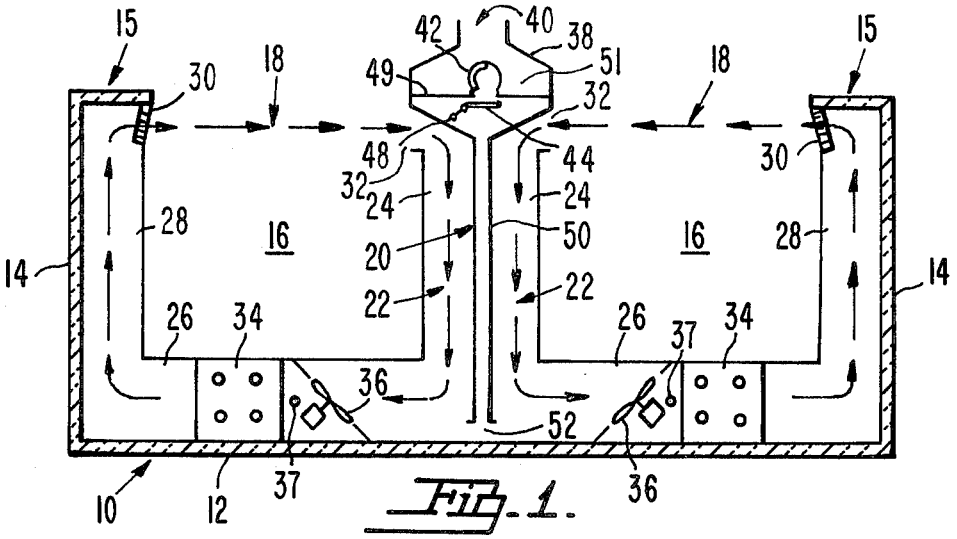
FIG. 1 is a transverse sectional view through a wide island case constructed in accordance with the present invention, the case of FIG. 1 being of the type in which one side may be refrigerated to a temperature different from that of the other, the case being illustrated as it appears during a refrigerating cycle.

In FIGS. 1–5, the wide island case comprising the present invention has been generally designated 10, and includes an insulated bottom wall 12 and upstanding outer side walls 14 which, in cooperation with a central partitioning structure to be described, define side-by-side, upwardly opening wells 15 each having an open-topped product display space 16, through which access is had to the displayed products (not shown) through access openings 18.

A case of this type is often of great length, and extending from end-to-end thereof, longitudinally and centrally of the case, is a center partition 20 disposed vertically, midway between the outer side walls and in parallel relation thereto.

Extending about the outer and inner sides, and across the bottoms, of the respective product display spaces 16 are air ducts or passages 22. Each of these includes an air return flue or inner side passage 24, opening at its lower end into a lower air passage or plenum 26, and an outer side passage or air discharge flue 28 also communicating at its lower end with the lower air passage 26.

The outer side passages 28, at their upper ends, are provided with air outlet openings 30, while the inner side passages are provided at their upper ends with air inlet openings 32. These are described as outlet and inlet openings, in relation to their normal function during refrigerating cycles, in which air flows through the respective ducts in the directions shown by the arrows in FIG. 1, being discharged through the outlet openings 30 to flow directly across the access openings 18, reentering the ducts through the inlet openings 32. As well known in the art, this provides effective guard panels across the access openings, and serves to properly refrigerate, and maintain in a refrigerated condition, the products displayed within the spaces 16.

Within the plenums or lower passages 26, there are provided evaporator coils 34, and adjacent said coils primary circulating fans 36 are operated to produce the desired air flow through the ducts.

During refrigeration, the fans 36 are operated in a normal forward direction to effect the flow in the direction of the arrows shown in FIG. 1, wherein the air is drawn through the inlet openings 32, flowing downwardly through the return flues 24, and flowing outwardly from the center area across the bottoms of the display spaces through the coils to the outer side passages 28, for discharge through openings 30 after passing upwardly through the outer side passages.

It may be desired, during defrost, to provide supplemental heating for the evaporators, so as to reduce the total defrost time. For this purpose, there may be utilized electrical resistance heaters 37, which would be energized only during defrost cycles, or during portions of said cycles, should this be required due to particular temperature and humidity conditions occurring in the ambient atmosphere surrounding the case.

In accordance with the invention there is provided, extending longitudinally and centrally of the case at the top of the partition 20, a wide sill 38. Sill 38 is hollow, providing, in the form of the invention shown in FIG. 2, an inlet chamber for defrost air. The air is pulled into the inlet chamber from the ambient atmosphere above the case, through an upwardly opening main defrost air inlet 40, responsive to operation of a defrost fan 42 which preferably, though not necessarily, is of the tangential blower type.

It is desirable that there be no air movement through the hollow center partition 20 during refrigerating cycles, and to prevent this there is provided, in the form of the invention shown in FIGS. 1 and 2, a damper 44 hinged as at 46 below and at the outlet side of the blower 42, the damper being normally swung to a closed position by means of a counterweight 48.

Figure 2:
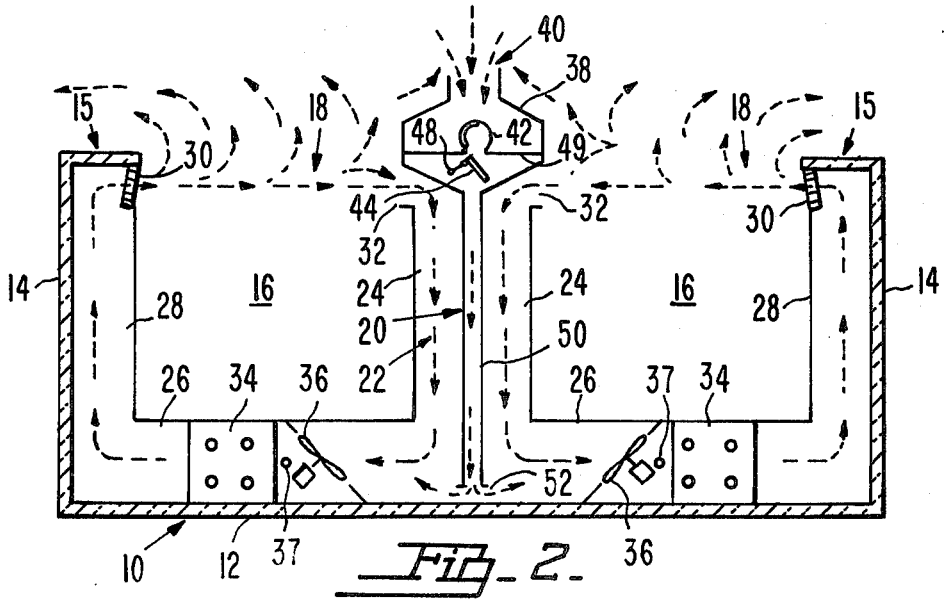
FIG. 2 is a transverse sectional view through the case of FIG. 1, as it appears during a defrost cycle with air being forced downwardly through the central defrost air passage.

When the blower 42 is operated, the force of the air pulled downwardly through the opening 40 and passing through the blower to the hollow partition 20, is effective to overcome the force of the counterweight 48, so that the damper swings to the open position shown in FIG. 2. During refrigerating cycles, however, when the blower 42 is off, the damper 44 is maintained in a closed position. Any tendency of the air flow patterns occurring within the case during refrigeration, to pull air downwardly through the opening 40, is overcome by the counterweighted damper, which under these circumstances remains in the FIG. 1 position, since the induced air flow that might otherwise occur during a refrigerating cycle is not strong enough to bias the damper to an open position. And, of course, the closed damper is similarly effective in preventing any upward flow of air through the hollow center partition during a refrigerating cycle.

Figure 11:
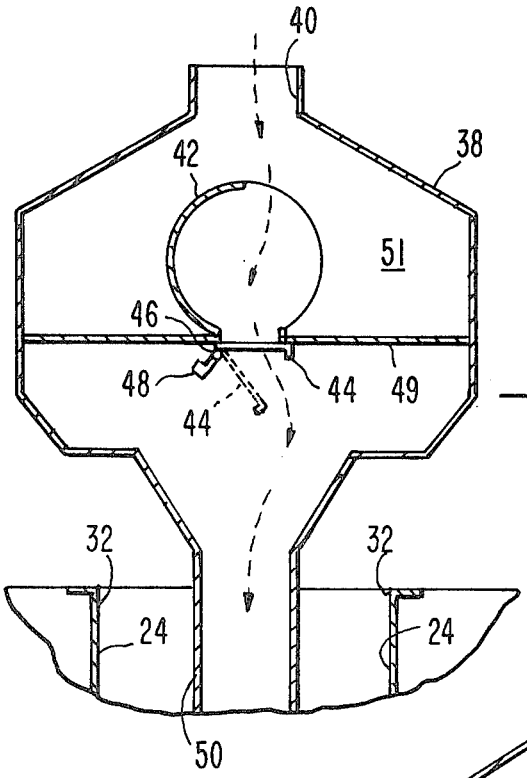
FIG. 11 is a greatly enlarged, transverse sectional view through the sill area of the wide island cases of FIGS. 1 and 6, in which the defrost fan is mounted to force air downwardly within the center partition.

The structural details of the damper of FIGS. 1 and 2 are illustrated in FIG. 11. Here it can be seen that in the closed position of the damper, the free edge portion of the damper abuts against the transversely disposed mounting plate 49 of the fan 42, so that air cannot pass upwardly through the center partition 20 and the air inlet chamber defined within the hollow sill 38.

The center partition defines, for its entire length, a central defrost air passage or flue 50, which at its upper end communicates with the defrost air inlet chamber 51, and at its lower end opens as at 52 in close proximity to the bottom wall 12, so that air exiting the passage 50 through its open lower end 52 is deflected in both directions during defrost as shown in FIG. 2, into the lower air passages or plenums 26, 26 of the respective product wells 15. In the embodiment of the invention shown in FIGS. 1 and 2, during refrigeration the defrost fan 42 is off, and the primary fans 36 are on and operating in a normal forward direction, to produce an air flow pattern in each product well 15 as shown by the arrows of FIG. 1. This is a typical air flow pattern of cases of this type. It is mainly important to note, in connection with the refrigeration cycle, that there is no air movement within the defrost air passage 50. Passage 50 thus extends as an effective, insulating divider between the resepective product wells. There being no air movement within the passage 50, it becomes an insulating type divider in that heat exchange between the ducts 22 located at opposite sides of the passage 50 is minimized by a dead air space defined between the opposite side walls of the defrost air passage.

This is of particular importance when, as is often true, the wide island case is of the type in which the product display spaces 16 are refrigerated to different temperatures. This may be true when one space holds ice cream and the other space contains frozen foods.

In the form of the invention shown in FIGS. 1 and 2, the defrost cycle is illustrated in FIG. 2. When the defrost cycle is initiated, refrigeration of the evaporator coils 34 is terminated, but the primary fans continue operating in a normal forward direction. As a result, a continuing air pattern, in the same direction as during refrigeration, is maintained about each product display space, as shown by the arrows in FIG. 2. This includes the movement of some of the air out of the outlet openings 30, across the product display space 16, and back into the inner side passage 24 of each duct 22. The remainder turns upwardly with part being directed upwardly and outwardly and the rest flowing upwardly and inwardly along the outside of the sill.

When the defrost cycle begins, fan 42 goes into operation. as a result, a continuous, fresh supply of ambient air, in a substantial volume, is drawn through defrost air inlet 40 from above the case, and is directed downwardly through the defrost air passage 50, overcoming the counterweight 48 and moving the damper 44 to an open position.

This continuing, fresh supply of ambient air is forced out of the lower end 52 of passage 50, and is split equally between the opposite sides of the case, entering the plenums 26 for circulation about the product display spaces 16 by fans 36.

Since there is a continuing, fresh supply of ambient air being drawn into the defrost air passage 50 at all times during the defrost cycle, some of the air, after discharge through the outlet openings 30, returns to ambient. It has been noted, further, that in the area of the inlets 32, additional ambient air becomes entrained in the air flow and enters the ducts.

It is also believed possible that in the embodiment shown in FIGS. 1 and 2, during the defrost cycle the primary fans might be turned off completely, in circumstances in which the blower 42 is selected to have a high volumetric capacity so as to assure that there will be an ample supply of ambient air for both sides of the case. In these circumstances, with fans 36 off, the air would flow in the same directions as shown in FIG. 2, except that conceivably, the strength of the protective guard panel across the access openings 18 might be diminished somewhat. It is mainly important to note that the invention is believed to encompass the concept wherein fans 36 might be turned off completely during defrost in the form of FIGS. 1 and 2.

Figure 3:
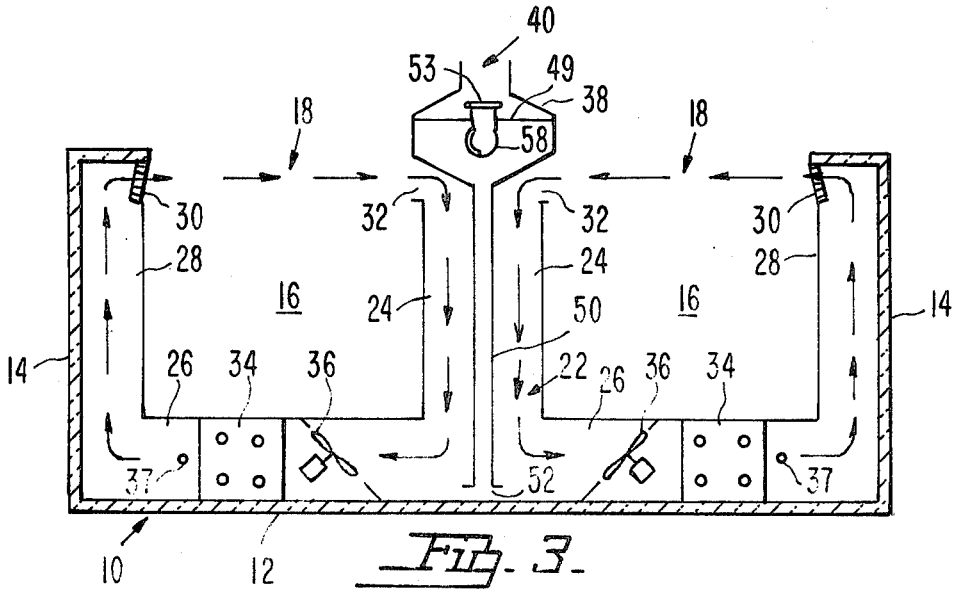
FIG. 3 is a transverse sectional view through a modified form of a wide island case constructed in accordance with the present invention, as it appears during refrigeration.

In FIG. 3, there is shown a modified construction as it appears during refrigeration. This form of the invention is identical to that shown in FIGS. 1 and 2, in almost every respect, and where the construction shown in FIG. 3 is identical to that shown in FIG. 1, the same reference numerals have been used.

Figure 4:
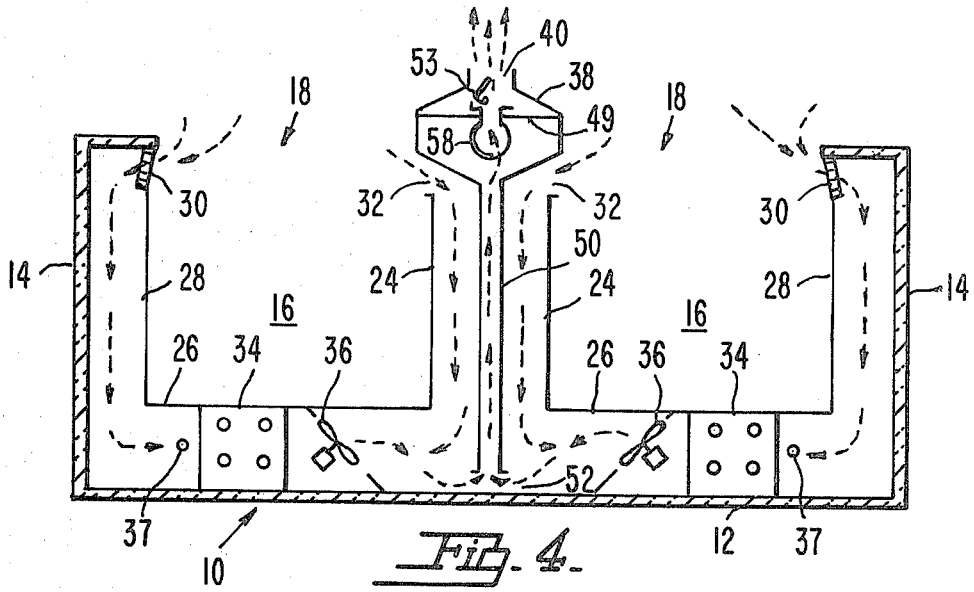
FIG. 4 is a transverse sectional view of the FIG. 3 case as it appears during defrost, with air being drawn upwardly through the central defrost air passage and with the primary fans off.
Figure 12:
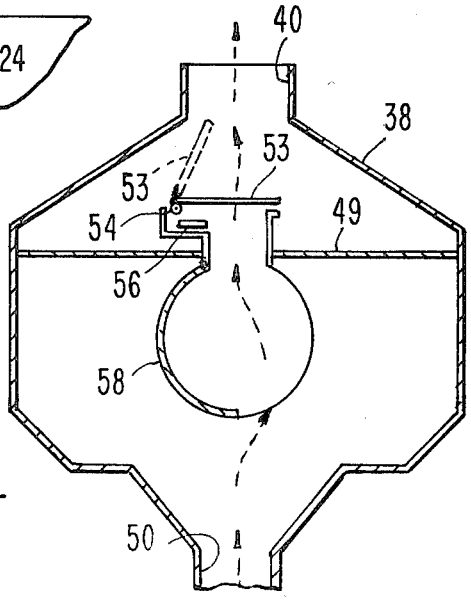
FIG. 12 is a view similar to FIG. 11, through the sill area of the cases illustrated in FIGS. 3 and 8, wherein the defrost fan is mounted in the sill for drawing air upwardly through the center partition.

The form of FIG. 3 differs from that of FIG. 1 in that the blower 58 is mounted within the hollow sill for operation in a direction opposite to that in which the blower 42 operates during defrost. In FIG. 3, the blower 58 is disposed below the mounting plate 49. As a result, the outlet side of the blower is directed upwardly toward the opening 40. Since this blower operates to pull air upwardly within the passage 50 and discharge it through the opening 40, there is provided a damper arranged as shown in FIGS. 3, 4 and 12. The damper has been designated 53, and is hinged for movement between the full and dotted line positions, through the provision of a hinge 54 (FIG. 12). A counterweight 56 is provided on the damper, tending to bias it to its normal full line position in which it prevents air movement through the passage 50. When blower 58 operates, the force of the air moved by the blower actuates damper 53 to the dotted line position shown in FIG. 12 and also shown in FIG. 4.

In FIG. 3, during refrigeration, the air flow pattern is identical to that shown in FIG. 1 and requires no further discussion.

During defrost, the air flow is as shown in FIG. 4. The primary fans 36 are turned off upon initiation of a defrost cycle, and of course, refrigeration of evaporator coils 34 is terminated at the same time. Blower 58 goes into operation when the defrost cycle is initiated, pulling air upwardly within passage 50 and exhausting it to ambient through opening 40. The air enters passage 50 through the lower open end 52.

As a result, blower 58 causes a continuing, fresh supply of ambient air to be drawn into the outer side passages 28 through outlet openings 30, to the plenum for passage through the coils 34. At the same time, a continuing fresh supply of ambient air is drawn through the inlet openings 32, for passage through the inner side passages or return flues 24, thus to melt any frost that has accumulated therein. All the air drawn into the plenums 26 through the several passages 24, 28 enters the open lower end 52, and is discharged to ambient by the operation of the fan 58.

Figure 5:
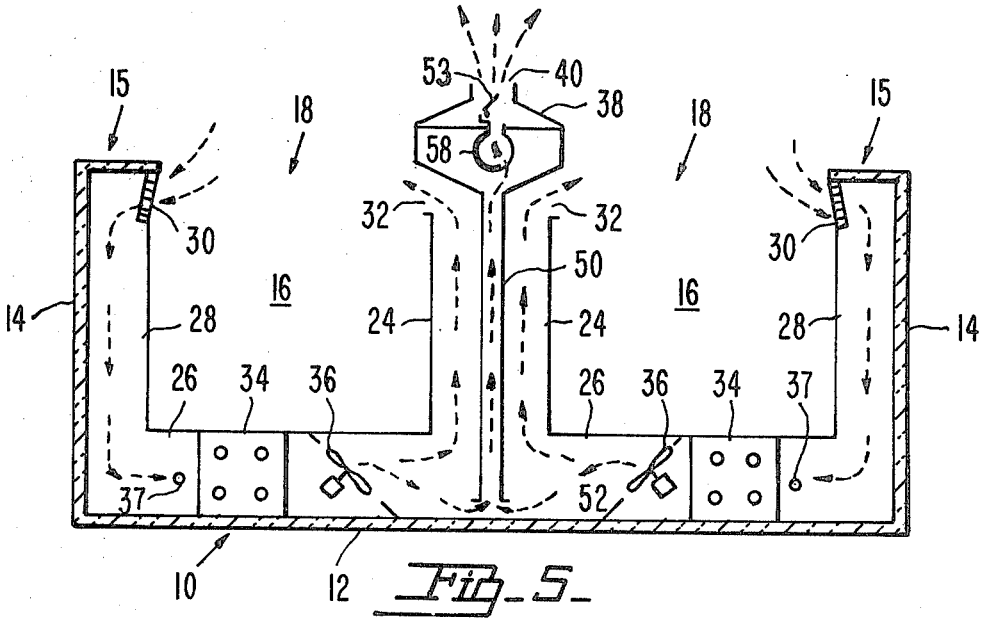
FIG. 5 is a view similar to FIG. 4, illustrating the FIG. 3 case during defrost, with air being drawn upwardly through the central defrost passage and with the primary fans reversed.

In FIG. 5, the construction of the case is identical to that in FIGS. 3 and 4. In this instance, however, the fans 36 are of the reversible type. Accordingly, during defrost, upon termination of refrigeration of coils 34, fans 36 begin to operate in a reverse direction and blower 58 operates to pull air upwardly within the defrost air passage 50. Operation of the fans 36 is effective to cause a continuing, fresh supply of ambient air to be drawn into the outlet openings 30, for passage through the coils 34. However, the amount of air drawn into the ducts by the reversely operated fans 36 is greater than the amount that can be pulled upwardly through passage 50 by fan 58. Accordingly, some of the air drawn into the ducts by fans 36 when they are operated in a reverse direction is forced upwardly within the return flues or inner side passages 24, for discharge through openings 32, thus serving to melt frost that has accumulated within the passages 24.

Figure 6:
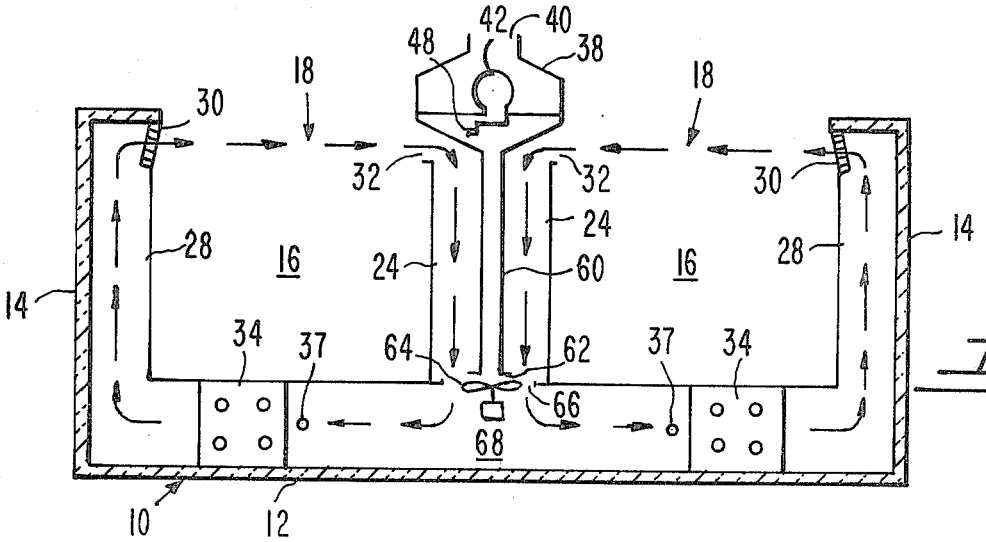
FIG. 6 is a transverse sectional view through another form of the invention, illustrating a case of the type in which both sides would be refrigerated equally, the case being shown during a refrigerating cycle.
Figure 7:
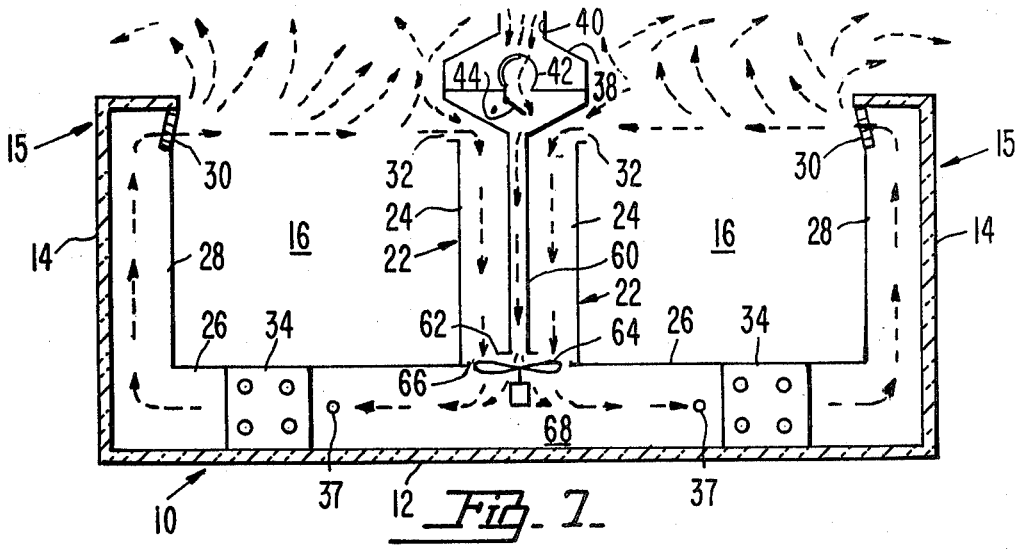
FIG. 7 is a transverse sectional view through the FIG. 6 case, as it appears during defrost with air being drawn downwardly through the center passage and with the primary fan being on in a normal forward direction.

In the form of the invention shown in FIGS. 6 and 7, the wide island case is designed for maintenance of the product display spaces 16 at equal temperatures. In this type of case, accordingly, the lower air passages 26 of the ducts combine to form a single, continuous plenum common to both sides of the case and extending across the full width thereof.

Accordingly, the center partition 60 has its lower end 62 terminating substantially coextensively with the lower ends of the inner side passages 24, where said side passages 24 open into the common plenum at the bottom of the case. A primary circulating fan 64 is provided in close proximity to the coextensive lower ends of the passages 24 and 60. During refrigeration, fan 64 is on to pull air downwardly within the passages 24, the air that is so moved being then directed in opposite directions within the plenum, for passage through the coils 34. The chilled air is then directed upwardly within the outer side passages 28, and through the outlet openings 30, and travels across the access openings similarly to the basically conventional flow pattern of refrigerated air for cases of this type as previously described with reference to FIGS. 1 and 3.

It may be noted, with respect to the refrigeration cycle shown for the form of wide island case illustrated in FIG. 6, that there will be no air movement within the center partition 60, since it opens upon the center of the fan 64 where there is little force developed to draw air downwardly within the passage 60. Any tendency of air to flow downwardly within passage 60 during refrigeration is overcome by the force of the counterweight which under these circumstances retains damper 44 in closed position.

The defrost cycle for the form of the invention illustrated in FIG. 6 is seen in FIG. 7. In these circumstances the primary fan 64 continues to operate, after refrigeration of coil 34 has been terminated, and operates in its normal forward direction to direct air downwardly through opening 66 in which fan 64 is mounted and which serves as a common outlet for return flues 24, into the common plenum 68 defined across the entire width of the bottom of the case. At the same time, however, blower 42 goes into operation to draw air downwardly through the opening 40, forcing the air into the common plenum 68. Damper 44 is biased to an open position by the force of the air moved by the defrost fan or blower 42.

The continuing, fresh supply of ambient air entering plenum 68 from defrost air passage 60 is split equally between the opposite sides of the case, and is forced in the direction of the arrows within the ducts 22, passing through the coils 34, and out of the openings 30. Some of the air flows across the access openings of the product display spaces 16 for re-entry into the ducts through openings 32.

Since the blower is supplying the ducts with a continuing fresh supply of ambient air at all times, some of the air discharged through openings 30 will be returned to ambient as shown, in an amount equal to that which is being drawn through openings 40 into the passage 60.

This is highly desirable, in that it maintains the defrost air supply at a suitably high temperature to accomplish defrost in a relatively short period of time. At the same time, however, a protective guard panel still extends across the display space as shown in FIG. 7, to protect the displayed products against the intrusion of the ambient atmosphere.

Figure 8:
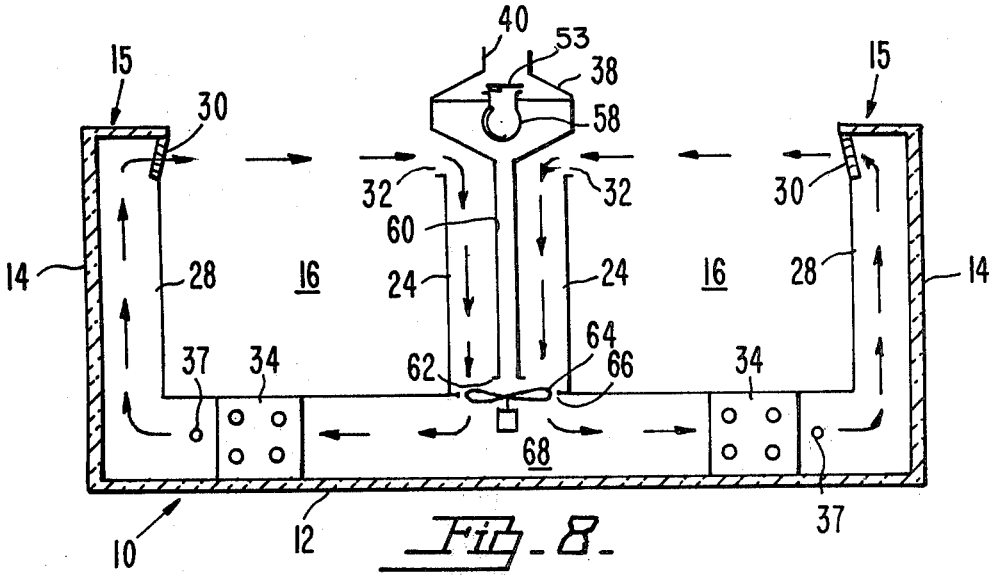
FIG. 8 is a transverse sectional view through yet another form of wide island case, the case also being of the type in which both sides may be refrigerated to an equal extent, the case being shown during a refrigerating cycle.

In FIG. 8, the construction is identical to that shown in FIG. 6, with the exception of the mounting and the direction of operation of the defrost fan. In FIG. 8, the fan 58 is mounted as in the form of the invention shown in FIGS. 3 and 4. In FIG. 3, however, the case is of the type in which opposite sides may be refrigerated to different temperatures, whereas in FIG. 8, the case is of the type in which both sides of the case would be refrigerated to the same or substantially equal temperatures.

Thus, the primary fan arrangement, and the construction and relative arrangement of the defrost air passage 60 and duct passages 24, are the same as in FIGS. 6 and 7, while the defrost fan arrangement is the same as that shown in FIGS. 3 and 4.

During refrigeration, in the form of the invention shown in FIG. 8, defrost fan 58 is off, and the single primary fan 64 operates to produce a flow pattern as shown in this figure of the drawing. Since this pattern is identical to that previously described in reference to FIG. 6, it need not be further discussed here.

Figure 9:
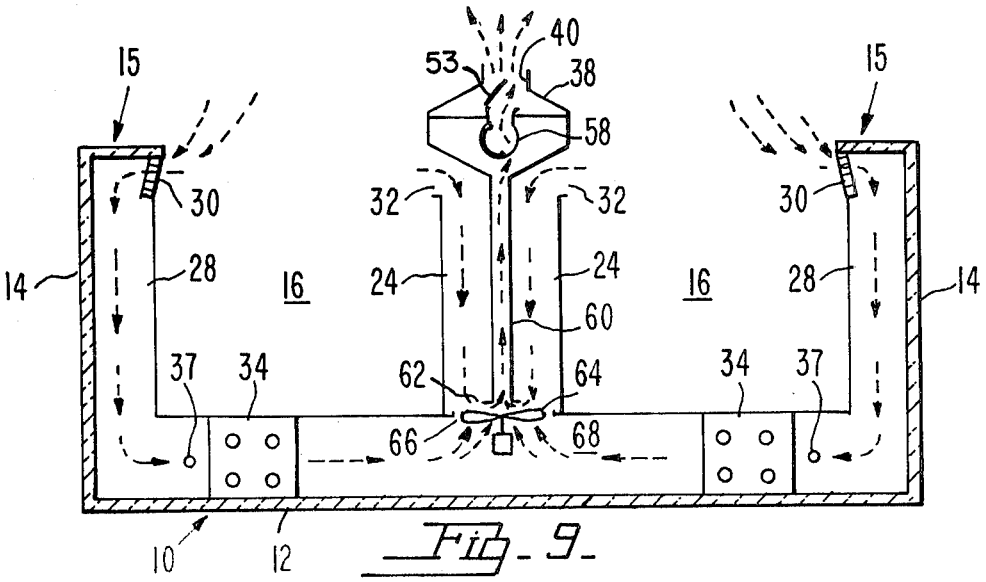
FIG. 9 is a transverse sectional view through the case illustrated in FIG. 8, as it appears during one defrost mode in which the defrost air is drawn upwardly through the center partition and the primary fan is off.

FIG. 9 shows the case of FIG. 8 as it appears during defrost, in one defrost mode that is possible for this construction. Thus, in FIG. 9 refrigeration of the coils 34 has been terminated, and the single primary fan 64 is turned off. Blower 58 is on, and pulls air upwardly within passage 60 for discharge to ambient through opening 40. The blower 58 is of a strength sufficient to pull air into the passages 28, 24 through the outlet openings 30, 32 respectively as shown by the arrows in FIG. 9. This air moves downwardly within the side passages 28, 24, entering the common plenum 68 from the opposite sides thereof, and moving toward the center of the case through the coils 34. All air drawn into the case is pulled upwardly within the passage 60 to discharge to ambient. A continuing, fresh supply of ambient air is thus assured during defrost.

Figure 10:
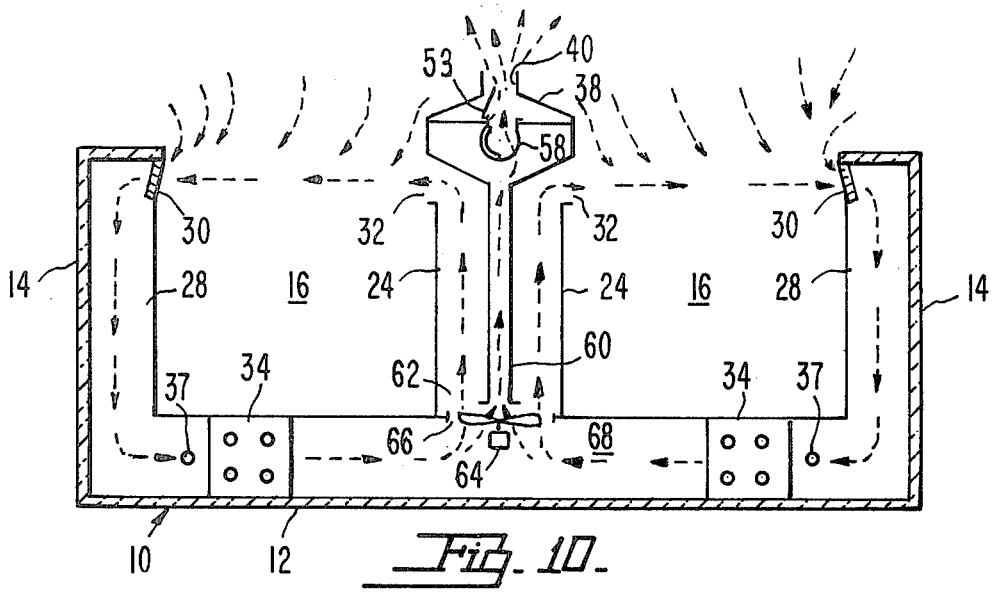
FIG. 10 is a similar view of the FIG. 7 case illustrating another defrost mode in which air is drawn upwardly through the center partition and the primary fan is reversed.

In FIG. 10, there is illustrated an alternative defrost mode for the case shown in FIG. 8. In this form of the invention, the fan 64 is of the reversible type, and goes into reverse operation at the initiation of the defrost cycle, when refrigeration of the coils 34 has ceased. At the same time, blower 58 goes into operation, opening damper 52 and pulling air upwardly within the passage 60.

The fan 64, when reversely operated, forces air upwardly within the inner side passages 24, and out of the inlet openings 32. At the same time, it pulls air into the outer side passages 28, so that a protective guard curtain is developed across the access openings.

A continuing fresh supply of ambient air is of necessity drawn into the outlet openings 30, in an amount equal to that which is being continuously discharged through opening 40. As a result, an effective, rapid defrost of the coils 34 is achieved.

In all forms of the invention, the supplemental heaters 37 can be turned on during defrost, if necessary, to act as a supplement or aid in defrosting of the coils 34. These heaters would, of course, in every instance be located on the upstream sides of their associated coils, in the sense of the air direction during the defrost cycle.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In a refrigerated display case of the wide island, air-defrosted type having a pair of side-by-side product wells each of which includes a product display space having an access opening at its top and an air duct that extends about the sides and bottom of the display space and is formed at its end with inlet and outlet openings respectively located at opposite sides of the access opening, each duct including a lower passage extending along the bottom of the display space and inner and outer side passages respectively extending along opposite sides of the display space, the inner side passages of the respective ducts being laterally spaced from each other and being individual to their associated ducts, evaporators in the respective ducts, and primary fan means for circulating air through the ducts, the improvement comprising:

(a) a central partition occupying the space between the inner side passages of the respective ducts, said partition being hollowly formed to provide a defrost air passage that is separate from the respective inner side passages and in which air is quiescent during refrigeration of the case to define an insulating air space between the inner side passages during refrigeration, said defrost air passage having upper and lower ends, the lower end opening upon and being common to both ducts, said lower end comprising the sole location at which the defrost air passage is in communication with the ducts;

(b) a hollow sill overlying the partition in communication with the upper end of the defrost air passage and with the ambient atmosphere, whereby the sill and defrost air passage combine to provide a flow path limited to the flow of defrost air and extending between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case.

2. In a refrigerated display case of the wide island type, as in claim 1, the improvement wherein the lower end of the central defrost air passage opens upon the ducts in the area of the lower air passages thereof.

3. In a refrigerated display case of the wide island type, as in claim 1, the improvement wherein, during a defrost cycle, the defrost fan means operates in a direction to pull air upwardly from both ducts through the lower end of the defrost air passage and force it out of the sill into the ambient atmosphere, whereby to draw air during the defrost cycle from the ambient atmosphere into each duct through at least one of the openings thereof.

4. In a refrigerated display case of the wide island type, as in claim 1, the improvement wherein the primary fan means comprises a primary fan located in each lower air passage.

5. In a refrigerated display case of the wide island type, as in claim 1, the improvement wherein, during the defrost cycle, the defrost fan means operates in a direction to draw air into the sill from the ambient atmosphere and force the air downwardly through the central defrost air passage and out of the lower end thereof symmetrically in respect to both ducts so as to split the air into generally equal parts for passage through the evaporators of the respective ducts.

6. In a refrigerated display case of the wide island type, as in claim 5, the improvement wherein, during the defrost cycle, the primary fan means operate in the same direction as during the refrigerating cycles of the case.

7. In a refrigerated display case of the wide island type, as in claim 5, the improvement wherein the primary fan means comprise a pair of primary fans, one in each of the lower air passages, the primary fans being on and operating in a normal forward direction during the defrost cycles of the case.

8. In a refrigerated display case of the wide island type, as in claim 7, the improvement wherein, during the defrost cycles, ambient air exiting from the defrost air passage and entering the respective lower passages is forced by the respective primary fans out of the respective outlet openings and across the respective access openings to maintain protective air curtains over the respective product display spaces.

9. In a refrigerated display case of the wide island type, as in claim 1, the improvement that includes a means for preventing the movement of air through the defrost air passage and sill whenever the case is in its refrigeration cycle.

10. In a refrigerated display case of the wide island type, as in claim 9, the improvement wherein the air-movement-preventing means is a damper that extends across the flow path along which air moves through the defrost air passage and sill, the damper being normally closed during the refrigeration cycle and being open during the defrost cycle of the case.

11. In a refrigerated display case of the wide island type, as in claim 10, the improvement wherein the damper is provided with means tending to bias it toward its closed position while being yieldable in the presence of air moved along the flow path in the "on" condition of the defrost fan means.

12. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the defrost fan means operating during a defrost cycle in a direction to pull air upwardly from both ducts through the lower end of the defrost air passage and force it out of the sill into the ambient atmosphere, whereby to draw air during the defrost cycle from the ambient atmosphere into each duct through at least one of the openings thereof, the primary fan means of the respective wells being located at opposite sides of the lower end of the defrost air passage and are reversed during defrost cycles, to force air within the respective ducts toward the lower end of the defrost air passage.

13. In a refrigerated display case of the wide island type, as in claim 12, the improvement wherein the primary fan means comprise separate fans mounted in the respective lower air passages of the ducts, symmetrically in respect to the central defrost air passage.

14. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the defrost fan means operating, during a defrost cycle, in a direction to pull air upwardly from both ducts through the lower end of the defrost air passage and force it out of the sill into the ambient atmosphere, whereby to draw air during the defrost cycle from the ambient atmosphere into each duct through at least one of the openings thereof, the primary fan means, during defrost cycles, being in an off condition and the auxiliary fan means constituting the sole force for drawing ambient air into the respective ducts for passage through the respective evaporators.

15. In a refrigerated display case of the wide island type, as in claim 14, the improvement wherein, during defrost cycles, the defrost fan means is operable with a power effective to draw air from the ambient atmosphere through the several inlet and outlet openings for flow downwardly through the several outer and inner side passages and through the respective lower passages of the duct into the lower end of the central defrost air passage.

16. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the defrost fan means, during the defrost cycle, operating in a direction to draw air into the sill from the ambient atmosphere and force the air downwardly through the central defrost air passage and out of the lower end thereof symmetrically in respect to both ducts so as to split the air into generally equal parts for passage through the evaporators of the respective ducts, the primary fan means operating in the same direction as during the refrigerating cycles of the case, the primary fan means comprising a primary fan common to both ducts, the common primary fan being disposed in close proximity to and extending across the central defrost air passage and both of the respective inner side passages of the ducts at the location at which the inner side passages and defrost air passage open into the lower passages of the ducts.

17. In a refrigerated display case of the wide island type, as in claim 16, the further improvement wherein the inner side passages of the ducts, and the central defrost air passage are substantially coextensive at the locations at which they open into the lower passages of the ducts.

18. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the improvement that includes a means for preventing the movement of air through the defrost air passage and sill whenever the case is in its refrigeration cycle, the air-movement-preventing means comprising a damper that extends across the flow path along which air moves through the defrost air passage and sill, the damper being normally closed during the refrigeration cycle and being open during the defrost cycle of the case, the damper being provided with means tending to bias it toward its closed position while being yieldable in the presence of air moved along the flow path in the "on" condition of the defrost fan means, the damperbiasing means comprising a counterweight.

19. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the defrost fan means operating during the defrost cycle in a direction to draw air into the sill from the ambient atmosphere and force the air downwardly through the central defrost air passage and out of the lower end thereof symmetrically in respect to both ducts so as to split the air into generally equal parts for passage through the evaporators of the respective ducts, the primary fan means being in an off condition during the defrost cycles of the case.

20. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the defrost fan means operating during a defrost cycle in a direction to pull air upwardly from both ducts through the lower end of the defrost air passage and force it out of the sill into the ambient atmosphere, whereby to draw air during the defrost cycle from the ambient atmosphere into each duct through at least one of the openings thereof, the primary fan means, during defrost cycles, being reversed to draw ambient air into the ducts through the outlet openings, the defrost fan means being operable to return to the ambient atmosphere a portion of the air drawn into the respective ducts, the primary fan means being operable to force out of the inlet openings the remainder of the air drawn into the ducts from the ambient atmosphere.

21. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the defrost fan means operating during the defrost cycle in a direction to draw air into the sill from the ambient atmosphere and force the air downwardly through the central defrost air passage and out of the lower end thereof symmetrically in respect to both ducts so as to split the air into generally equal parts for passage through the evaporators of the respective ducts, the primary fan means operating during the defrost cycle in the same direction as during the refrigerating cycles of the case, the primary fan means comprising a primary fan common to both ducts.

22. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defroat fan being off during refrigeration cycles of the case and being on during defrost cycles, for transferring air between the ambient atmosphere and both ducts along the flow path through the sill and the defrost air passage, during the defrosting of the case, the primary fan means comprising a single primary fan common to both ducts and mounted in close proximity to the central defrost air passage and to the inner side passages of the respective ducts, the defrost fan means being operable in a direction to pull air upwardly through the defrost air passage from the bottom passages of the ducts and the primary fan being reversed during defrost cycles to draw air from the ambient atmosphere through the several inlet and outlet openings and cause the same to flow downwardly through the several outer and inner side passages to flow into the lower passages of the ducts and defrost air passage.

23. In a refrigerated display case of the wide island, air-defrosted type having a pair of side-by-side product wells each of which includes a product display space having an access opening at its top and an air duct that extends about the sides and bottom of the display space and is formed at its ends with inlet and outlet openings respectively located at opposite sides of the access opening, each duct including a lower passage extending along the bottom of the display space and inner and outer side passages respectively extending along opposite sides of the display space, evaporators in the respective ducts, and primary fan means for circulating air through the ducts, the improvement comprising:

(a) a central partition located between the inner side passages of the respective wells, and hollowly formed to provide a defrost air passage having upper and lower ends, the lower end opening upon and being common to both ducts;

(b) a hollow sill overlying the partition in communication with the upper end of the defrost air passage and with the ambient atmosphere, whereby the sill and defrost air passage combine to provide a flow path between the ambient atmosphere and both ducts; and (c) a defrost fan mounted on the sill, the defrost fan being off during refrigeration cycles of the case and being on during defrost cycles, for transferring air between the ambient atmosphere and both ducts along the flow path through the sill and the defrost air passage, during the defrosting of the case, the primary fan means comprising a single primary fan common to both ducts and mounted in close proximity to the central defrost air passage and to the inner side passages of the respective ducts, the defrost fan means being operable, during defrost cycles, in a direction to draw air through the several outer and inner side passages and lower passages and thereafter upwardly through the defrost air passage with the primary fan in its off condition.

* * * * *

UNITED STATES PATENT AND TRADEMARK OFFICE

CERTIFICATE OF CORRECTION

PATENT NO. : 4,483,153

DATED : November 20, 1984

INVENTOR(S) : George E. Wallace

It is certified that error appears in the above-identified patent and that said Letters Patent are hereby corrected as shown below:

Column 16, line 54, change "defroat" to -- defrost --.

Signed and Sealed this

*Seventh* Day of *May 1985*

[SEAL]

*Attest:*

DONALD J. QUIGG

*Attesting Officer* *Acting Commissioner of Patents and Trademarks*